US008159319B2

(12) United States Patent
Ferree

(10) Patent No.: US 8,159,319 B2
(45) Date of Patent: Apr. 17, 2012

(54) DOUBLE-BREAKING CONTACT SYSTEM FOR A LOW VOLTAGE CIRCUIT BREAKER, A MOLDED CASE CIRCUIT BREAKER COMPRISING THE DOUBLE-BREAKING CONTACT SYSTEM, AND A METHOD FOR BREAKING A CIRCUIT

(75) Inventor: James Ferree, Lawrenceville, GA (US)

(73) Assignee: Siemens Aktiengesellschaft, Munich (DE)

( * ) Notice: Subject to any disclaimer, the term of this patent is extended or adjusted under 35 U.S.C. 154(b) by 397 days.

(21) Appl. No.: 12/449,112

(22) PCT Filed: Jan. 24, 2007

(86) PCT No.: PCT/IB2007/001723

§ 371 (c)(1),
(2), (4) Date: Jul. 23, 2009

(87) PCT Pub. No.: WO2008/090398

PCT Pub. Date: Jul. 31, 2008

(65) Prior Publication Data

US 2009/0321233 A1 Dec. 31, 2009

(51) Int. Cl.
*H01H 75/00* (2006.01)
*H01H 53/00* (2006.01)

(52) U.S. Cl. ..... 335/16; 200/244; 335/147; 335/195

(58) Field of Classification Search ..... 335/6, 14–16, 335/147, 195; 200/244
See application file for complete search history.

(56) References Cited

U.S. PATENT DOCUMENTS

| | | | |
|---|---|---|---|
| 3,343,108 | A | 9/1967 | Murai |
| 4,649,247 | A | 3/1987 | Manthe |
| 5,073,764 | A | 12/1991 | Takahashi et al. |
| 2002/0175785 | A1 | 11/2002 | Asada et al. |

FOREIGN PATENT DOCUMENTS

| | | | |
|---|---|---|---|
| DE | 1 563 842 | A1 | 11/1970 |
| DE | 23 38 637 | A1 | 2/1975 |
| DE | 27 20 736 | A1 | 12/1977 |
| EP | 0 003 447 | A1 | 8/1979 |
| EP | 0 174 904 | B1 | 5/1988 |
| EP | 0 418 754 | A2 | 3/1991 |
| EP | 1 069 584 | A1 | 1/2001 |
| GB | 1 519 559 | | 8/1978 |

*Primary Examiner* — Ramon Barrera
(74) *Attorney, Agent, or Firm* — Harness, Dickey & Pierce, P.L.C.

(57) ABSTRACT

A concept of a double-breaking contact system with a rotating contact arm is disclosed. In at least one embodiment, a novel arrangement of fixed conductors that cross over the contact arm is presented. A double-breaking contact system for a low voltage circuit breaker of at least one embodiment includes a double-breaking contact arm extending along a longitudinal axis and being rotatable across a central bearing; a first fixed conductor and a second fixed conductor, each conductor contacting one end of the contact arm, respectively and having first segments below the contact arm, second segments above the contact arm and third segments crossing over the contact arm and connecting the first segments with the corresponding second segments of each conductor; wherein the first segments and/or the second segments are arranged parallel to each other for guiding a current in a parallel direction through the respective first and/or second segments, but reverse to the current in the contact arm.

34 Claims, 10 Drawing Sheets

DOUBLE-BREAKING CONTACT SYSTEM FOR A LOW VOLTAGE CIRCUIT BREAKER, A MOLDED CASE CIRCUIT BREAKER COMPRISING THE DOUBLE-BREAKING CONTACT SYSTEM, AND A METHOD FOR BREAKING A CIRCUIT

PRIORITY STATEMENT

This application is the national phase under 35 U.S.C. §371 of PCT International Application No. PCT/IB2007/001723 which has an International filing date of Jan. 24, 2007, which designated the United States of America, the entire contents of which are hereby incorporated herein by reference.

FIELD

At least one embodiment of the invention is generally related to a double-breaking contact system for a low voltage circuit breaker, a molded case circuit breaker comprising the double-breaking contact system, and/or a method for breaking the current in a low voltage circuit.

BACKGROUND

A circuit breaker is an automatically-operated electrical switch which protects an electrical circuit from damage caused by overload or short circuit. In contrast to a fuse, a circuit breaker can be reset to resume normal operation. Many different technologies are used in circuit breakers. One technology includes the field of low-voltage current-limiting Molded Case Circuit Breakers (MCCBs). One of the primary functions is limitation of fault current during a short circuit. When a short circuit occurs, the MCCB is expected to stop the flow of current as quickly as possible to protect conductors and electrical devices in the circuit downstream from the MCCB. The measures of an MCCB's current-limiting ability include the time duration of the fault current, the peak instantaneous let-through current (Ip), and the Joule integral, i.e. J i2dt, where is the instantaneous let-through current and t is time, integrated over the time duration. When an MCCB is declared by the manufacturer to "current-limiting" there are defined maximum limits for Ip and the Joule integral. However, it is generally advantageous to minimize all 3 of these measures in current-limiting MCCBs, to provide the best possible protection of the downstream circuit.

MCCBs typically contain one or more pairs of electrical contacts that close to allow current to flow and open ("break") to stop the flow of current. The interruption of a flow of a short circuiting current results in an electromagnetic repulsion between a stationary and a movable contact arm causing the arms to separate. During a short circuit event there are very high currents, which means that much inductive and capacitive circuit energy must be dissipated when an MCCB opens and interrupts the fault. When the contacts open, this energy causes an electric arc to form between the contacts. The energy dissipation causes hot conductive plasma near the contacts that allows current to continue to flow.

In order to stop the current flow, MCCBs typically contain metal splitter plates to absorb energy, cool the arc, and reduce the conduc-tivity of the gases. This causes in increase in voltage across the arc, which in turn acts counter to the System voltage, so the flow of current is reduced and eventually stopped. But arc resistance is a function not only of arc conductivity, but also of the length of the arc.

It is extremely important to increase the length of the arc as quickly as possible during a short circuit, to increase the arc voltage and stop the flow of current quickly. Because of this, MCCBs usually have blow-apart contacts, in which the extremely high currents from the short circuit cause magnetic fields, repelling the contacts from each other. Because the blow-apart motion is independent of the operating mechanism motion, blow-apart contacts are able to open much faster during a short circuit than the operating mechanism is able respond. During normal switching operations, the contacts are opened and closed by a toggle spring operating mechanism, by moving a handle.

Alternatively the mechanism can trip and open the contacts automatically. Typically an MCCB includes a trip unit that senses overload currents and responds by actuating the tripping Operation of the mechanism. The trip unit may include a bimetallic strip which is bent and releases a spring-loaded trip-lever if a threshold current is exceeded. Since the heating is fairly slow, another mechanism may be employed to handle large surges from a short circuit. A small electromagnet consisting of one or more conductor loops around a piece of iron will pull an iron armature instantly in case of a large current surge. Alternatively many MCCBs have electronic trip units that contain current sensors, microprocessors, and electromechanical devices that actuate the tripping operation of the mechanism.

There are several methods that have been used for increasing the separation speed of blow-apart contacts. First, there is the simple reverse loop, as shown in FIGS. 1 and 2. An example is the Siemens MCCB catalog number 3VL1716-1 DA33. In a reverse loop, a fixed conductor with a fixed contact is parallel to a moving contact arm. This creates parallel conductors with current flow in opposite directions, resulting in magnetic repulsion of the conductors.

Second, there is the double-blow-apart contact arms concept, shown in FIGS. 3 and 4. This is similar to the reverse loop, but here instead of a fixed contact, both contacts are attached to movable contact arms that mutually repel each other. This essentially doubles the speed and acceleration of contact separation. An example is the Siemens MCCB catalog number MLFB 3VL3725-3DC36.

Third, there is the reverse loop combined with a return loop on the other side of the moving contact arm, as shown in FIGS. 5, 6, and 7. An example is the Moeller NZM Nl. The return loop is parallel to the contact arm. Current flow is in the same direction in both the contact arm and the return loop, therefore the two conductors mutually attract each other. This provides an incremental improvement in speed and acceleration compared to the simple reverse loop.

Fourth, there is the rotating, double-breaking contact system, shown in FIGS. 8, 9 and 10. This concept is described, for example, in Siemens European Patent EP 0174904B1, also described in U.S. Pat. No. 4,649,247. An example is the Schneider MCCB type NS250. There is a rotating contact arm and 2 pairs of contacts that break essentially simultaneously, essentially doubling the speed and acceleration of contact separation, compared to a single pair of contacts. The double-breaking System in this example is used in combination with reversed loops.

Fifth, ferromagnetic material, steel for example, is sometimes used in combination with blow-apart contact systems, to intensify the magnetic field and increase the force on the contact arm. A wide variety of arrangements are possible with ferromagnetic material. Four simplified examples are shown; steel under the fixed contact (FIGS. 11 and 12), a partial slot motor (FIGS. 13 and 14), a full slot motor (FIGS. 15 and 16), and long legs on the arc splitter plates (FIGS. 17 and 18). In all of these methods of rapidly separating the contacts, whether by using conducting loops or ferromagnetic material, a magnetic field causes forces in the contact arm. It should be observed that in each of these cases the magnetic field also has a second benefit; it creates a force in the electric arc that pushes the arc into the splitter plates.

DE 27 20 736 discloses a current limiting device having a movable contact vigorously moved in the open circuit position by an electromagnetic repulsion device at the appearance of a short-circuit current. A retarding member is mechanically linked to the movable contact to delay the re-closing of the contact and to prevent a re-closing before tripping of the circuit breaker.

DE 23 38 637 discloses a contact arrangement for a circuit breaker with double blow-apart contact arms. Each movable contact arm is provided with a contact to a fixed arm. A third contact is provided between the two movable arms.

Another circuit breaker is disclosed in DE 15 63 842.

SUMMARY

At least one embodiment of the invention provides an improved circuit interrupter of the type including a two-point interruption mechanism suitable for performing an efficient interruption operation through an electromagnetic repulsion. The circuit interrupter comprises a stationary contact arm on the source side and a stationary contact arm on the load side and a movable contact assembly engaging a pair of the stationary contacts.

A current limiting apparatus is further described in EP 0 418 754. In a twin-contact type current limiting apparatus in which two contacts are electrically connected in series with each other, each of two movable contact arms extends substantially parallel with and along each of the two stationary contact arms, thereby obtaining balanced electromagnetic repulsions when an excessive current flows.

MCCB manufacturers are continually trying to improve the current-limiting performance. But it is also desirable for MCCBs to be compact in size, in order that circuit protection equipment does not use a lot of valuable space inside a building. Therefore the problem is to provide improved current-limiting performance in a small amount of space.

At least one embodiment of the present invention provides a system and a method for circuit-breaking with significant improvement in current-limiting performance, with little or no increase in the space required, compared to prior art.

Accordingly, a double-breaking contact system for a low voltage circuit breaker is provided, the system comprising a rotatable double-breaking contact arm extending along a longitudinal axis; a first fixed conductor and a second fixed conductor, each conductor contacting one end of the contact arm, respectively; having first segments below the contact arm, second segments above the contact arm and third segments crossing over the contact arm and connecting the first segments with the corresponding second segments of each conductor; wherein the first segments are arranged parallel to each other for guiding a current in a parallel direction through the respective first segments, but reverse to the current in the contact arm, and/or the second segments are arranged parallel to each other for guiding a current in a parallel di-reaction through the respective second segments, but reverse to the current in the contact arm.

In at least one embodiment, a double-breaking contact system includes two stationary conductors which are connected in the closed position via a rotating contact arm in the form of a double lever, which extends along a longitudinal axis and can pivot about a rotation axis which runs transversely with respect to the longitudinal axis, and two moving contacts which are arranged at the free ends of the rotating contact arm. The contacts point in mutually opposite directions and interact with fixed contacts which are respectively arranged on the first and the second conductor. In at least one embodiment, the two conductors, in the closed position when the contacts are closed, run transversely with respect to the rotating contact arm in the area of the rotation axis and essentially parallel to one another in the adjacent area, and are connected to one another via the rotating contact arm such that the current is fed back via the rotating contact arm. Further, in at least one embodiment, the current in each case flows in the same direction in the area which run in pairs parallel to the rotating contact arm.

At least one embodiment of the invention is that the fixed conductors provide twice the current for repelling the contact arm, compared with the prior art described above.

During a short circuit, each conductor carries the full short circuit current. Therefore, a total of two times the short circuit current flows parallel to the contact arm, repelling the short circuit current in the contact arm. This greatly increases the forces on the contact arm in comparison with, for example, the simple reversed loop.

It is preferred that the first fixed conductor and the second fixed conductor are provided staggered along a vertical axis with respect to each other, such that the first segment of the first conductor is arranged on top of and parallel to the first segment of the second conductor, and the second segment of the first conductor is arranged on top of and parallel to the second segment of the second conductor.

For breaking the current, pluralities of vertically stacked splitter plates are provided laterally adjacent to each end of the contact arm.

Preferably, third segments are arranged approximately at right angles to the longitudinal axis. The third segments are arranged to allow the contact arm to rotate between a first closed and a second open position. Said third segments cross said contact arm on different sides of the contact arm, respectively.

A second advantage of at least one embodiment is that the crossover segments have a current direction opposite to the direction of arcing currents formed between the end of the contact arm and the conductors. This creates a repulsion force that aids in pushing the arc into the splitter plates. Each crossover segment carries the full short circuit current, so this repulsion force is generated by two times the short circuit current.

The contact arm is provided with contacts fixed to each of its ends, respectively. The first fixed conductor and the second fixed conductor are each provided with a fixed contact, respectively. The fixed contacts contact the contacts of the contact arm in a closed position of the contact arm.

The first and second segments may be centered within the plane of motion of the contact arm. The first conductor may realized as the line conductor and the second conductor may be realized as the load conductor. Each conductor may be adapted to connect with an electrical circuit on its end, which is not connected to the contact arm.

In detail, the first conductor may comprise a first segment extending below and parallel to that side of the contact arm being provided with the first movable contact, the first segment being provided with a fixed contact on its upper surface for contacting the first movable contact in a first closed position of the contact arm; a second segment extending above and parallel to that side of the contact arm being provided with the second movable contact, the second segment providing contact to an electric circuit on its end distant to the center of the contact arm, and a third segment vertically crossing the contact arm and connecting the first segment and the second segment on their ends being close to the center of the contact arm.

The second conductor may comprise a first segment extending above and parallel to that side of the contact arm being provided with the second movable contact and below and parallel to the second element of the first conductor, the first segment being provided with a fixed contact on its lower surface for contacting the second movable contact in a first closed position of the contact arm; a second segment extending below and parallel to that side of the contact arm being provided with the first movable contact and parallel and below the first segment of the first conductor, the second segment providing contact to an electric circuit on its end distant to the center of the contact arm, and a third segment vertically crossing the contact arm and connecting the first segment and the second segment on their ends being close to the center of the contact arm.

The first and second conductors are isolated from each other when the contact arm is in the second open position.

The current arm may be capable of rotating between a first position providing a closed contact between an end of the contact arm with a corresponding end of the first conductor and the other end of the contact arm with the corresponding end of the second conductor, respectively, and a second open position following a short circuit, wherein the contacts between the conductors and the contact arm are adapted to allow the formation of current arcs and on either end of the contact arm.

The third segments may be arranged to guide a current in a direction opposite to the direction of the arc currents for creation of a repulsion force and for pushing the arcs into the respective splitter plates.

Preferably, vertical s-shaped like segments may be provided to connect to the first element of the second conductor and the second element of the first conductor, respectively, such that an upward current flow is provided in the level changing part of the s-shaped segment and a downward current flow is provided in the level changing part of the s-shaped segment. Advantageously, the flow of a current in the s-shaped segments attracts a respective current arc for guiding the arcs into the splitter plates.

Accordingly, a molded case circuit breakers (MCCB) comprising at least one contact system according to the invention, a molded case, a crossbar system providing a common carrier for the contact arms for actuating the opening and closing motion of a contact arm of the at least one contact system, the crossbar system being adapted to rotate around a pivot axis fixed in the molded case, the crossbar system containing spring mechanisms providing contact pressure and allowing the contact arm to open during a short circuit, an operating mechanism adapted to rotate the crossbar system open or closed; and a link adapted to connect and transfer motion from the operating mechanism to the crossbar system.

The operating mechanism may be realized as a handle and/or by a trip unit.

In a multi-pole system, a contact system may be provided for each pole of an electric circuit, the contact systems being arranged parallel to each other, the crossbar system providing a rigid connection between each contact arm. The crossbar system may be adapted to rotate the contact arms of all poles simultaneously and/or independently from each other.

Accordingly, also a method for breaking an electric current in a circuit following a short in double-breaking contact system for a low voltage circuit breaker comprising a rotatable double breaking contact arm extending along a longitudinal axis and; a first fixed conductor and a second fixed conductor, each conductor contacting one end of the contact arm, respectively, and having first segments below the contact arm, second segments above the contact arm and third segments crossing over the contact arm and connecting the first segments with the corresponding second segments of each conductor; the method comprising the step of providing a repulsion force between the current in the contact arm and the current in said first segments on one end of the contact arm by arranging the first segments parallel and adjacent to each other and guiding the current in a parallel direction through the first segments but in a reverse direction with respect to the current in the contact arm; providing a repulsion force between the current in the contact arm and the current in the second segments on the other end of the contact arm by arranging the second segments parallel and adjacent to each other and guiding the current in a parallel direction through the first segments but in a reverse direction with respect to the current in the contact arm.

The method may further comprise the step of rotating the contact arm from a first closed position to a second open position due to said repulsion force; formation of an electric arc between one end of the contact arm and a contact on the first conductor and formation of an electric arc between the other end of the contact arm and a contact on the second conductor; and creation of an additional repulsion force by guiding a current through the third segments in a direction opposite to the direction of the arc currents for pushing the arcs away from the center of the contact arm.

The system may further be provided with vertical s-shaped like segments connected to the first element of the second conductor and the second element of the first conductor, respectively, the method further comprising the steps of guiding a current flow upward in the level changing part of the s-shaped segment and downward in the level changing part of the s-shaped segment creating an attraction force through said guiding between the respective current arcs and the upward and downward current flow for guiding the arcs away from the center of the contact arm, respectively.

An advantage over the simple reversed loops in the prior art rotating double-break system, is that this invention does not have a return loop with disadvantageous current direction causing an attraction force that reduces the net blow-apart force from the reverse loop. That undesirable effect is not present in at least one embodiment of the invention.

Another advantage is that at least one embodiment of the invention uses a provided space more effectively.

Furthermore, an advantage is that the current in the vertical s-shaped segments is in direction that will produce an attractive force with the electric arcs producing the desirable effect of tending to move the arc into the splitter plates.

BRIEF DESCRIPTION OF THE DRAWINGS

In the following, embodiments of the invention will now be described in detail in conjunction with a number of drawings, List of Included Figures.

DETAILED DESCRIPTION OF THE EXAMPLE EMBODIMENTS

FIGS. 1 to 18 describe different embodiments of a circuit breaker as known in the art.

Embodiments of the present invention are shown in FIGS. 19 through 31. Embodiments of the invention use the concept of a double-breaking contact system with a rotating contact arm described above. In addition, embodiments of the invention have a novel arrangement of fixed conductors that cross over the contact arm.

Figure 19:
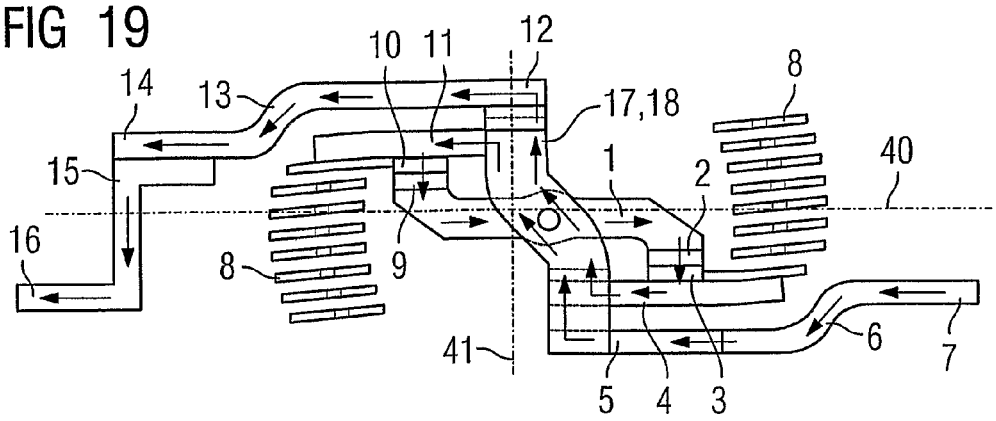
FIG. 19 Side view of embodiment of invention. Contact arm is in closed position. Arrows illustrate flow of electric current.
Figure 20:
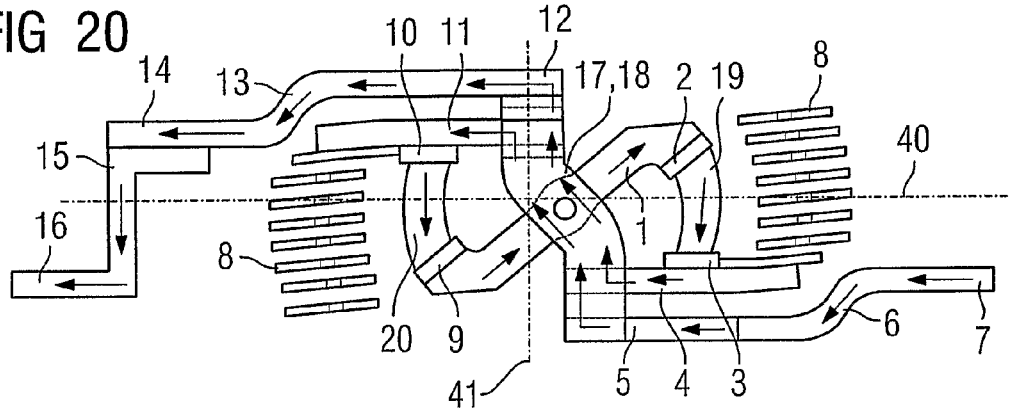
FIG. 20 Side view of embodiment of invention. Contact arm is in open position. Representations of the electric arc are shown between the contacts. Arrows illustrate flow of electric current.
Figure 21:
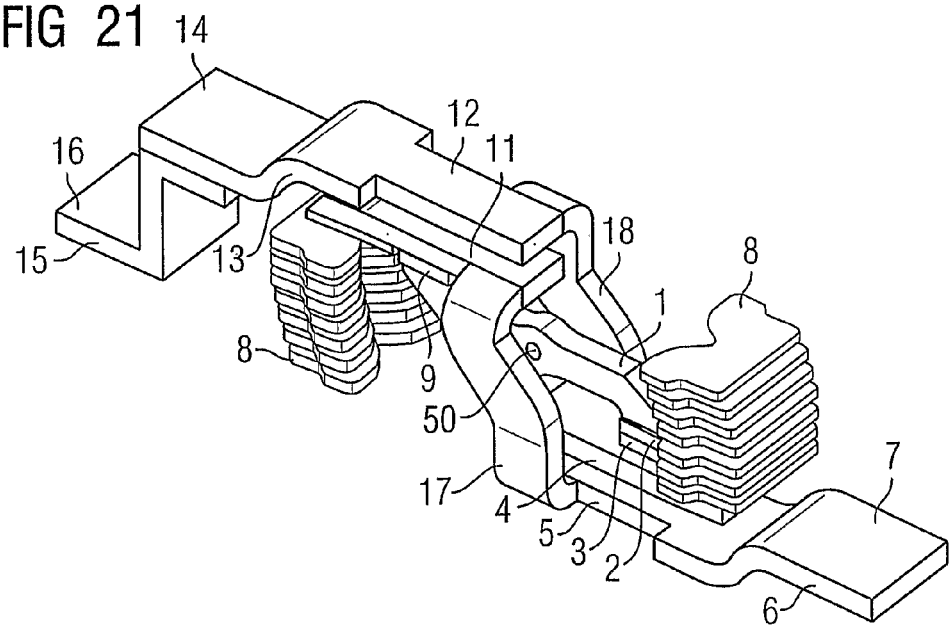
FIG. 21 Oblique view of embodiment of invention.

FIGS. 19 to 21 show a rotating contact arm 1 with movable contacts 2 and 9 fixed to each end. There are two fixed contacts 3 and 10 and two fixed conductors. The two fixed conductors are the line conductor and the load conductor. The line conductor is comprised of Segments 7, 6, 5, 17, and 11. The load conductor is comprised of segments 4, 18, 12, 13, and 14. The fixed contacts 3 and 10 are attached to these two fixed conductors as segments 4 and 11, respectively. Segments 4 and 11 are parallel to the contact arm, for a distance from the contact to approximately the rotating axis of the contact arm.

Then each fixed conductor has a second segment that crosses over to the other side of the contact arm. In the line conductor, segment 17 crosses over the contact arm to connect between segments 5 and 11. Likewise in the load conductor, segment 18 crosses over the contact arm, on the other side, to connect between segments 12 and 4. Crossover segments 17 and 18 are approximately at right angles to the contact arm, but are shaped to allow the contact arm to open.

Then each fixed conductor has a third segment that is parallel to the first segment of the other fixed conductor, respectively. That is, segment 5 is parallel to segment 4, and segment 12 is parallel to segment 11. Segments 4, 5, 11, and 12 are generally centered within the plane of motion of the contact arm. The crossover segments 17 and 18 are to the left and right of the contact arm, respectively.

Each fixed conductor then continues on and ends with a connection to the rest of the electrical circuit. In the example shown, the load conductor ends with a line terminal connection 7 for cabling or bus bar. The load conductor might ends with a connection 14 to the trip unit. Angled segments 6 and 13 are optional and are sometimes needed to bring the connection point to a convenient location in the circuit breaker.

The line and load conductors must be electrically isolated from each other when the contact arm is open. It is foreseen that there are many possible ways of designing the molded case to provide the required insulation. Many possible conducting paths are possible in the trip unit, and 15 is a simplified representation, which ends in a load terminal connection 16 for cabling or bus bar. The contact arm 1 is able to rotate through an angle from the closed position in FIG. 19 to the open position in FIG. 20.

In summary, a double-breaking contact system for a low voltage circuit breaker is provided, comprising a vertically central rotating contact arm (1) extending along a longitudinal axis (40), the axis or optional central bearing (50) dividing the contact arm (1) into a left side and a right side, a first fixed conductor (4; 12; 18) and a second fixed conductor (5; 11; 17), each crossing over the contact arm (1) in a vertical direction, the conductors comprising: a first segment (4; 5) extending parallel to and below the right side of the contact arm (1), a second segment (12; 11) extending parallel to and above the left side of the contact arm (1), and a third segment (18, 17) vertically connecting the first segment (4; 5) with the corresponding second segment (12; 11) of each conductor on their ends close to the centre of the contact arm (1) respectively, the third segments being arranged on either side of the contact arm (1); wherein the first and second fixed conductors are provided vertically staggered with respect to each other, such that the first segment (4) of the first conductor (4; 12; 18) is arranged on top of the first segment (5) of the second conductor (5; 11; 17) but parallel to each other and such that the second segment (12) of the first conductor (4; 12; 18) is arranged on top of the second segment (11) of the second conductor (5; 11; 17) but parallel to each other, the first segment (4) of the first conductor being adapted to contact the rotating arm (1) on its right end, the second element (12) of the first conductor being adapted to contact an electric circuit on its end distant to the centre of the contact arm (1); and the second segment (11) of the second conductor being capable of contacting the rotating arm (1) on its left end, the first element (5) of the second conductor being capable of contacting an electric circuit on its end distant to the centre of the contact arm (1).

Preferably, the contact arm (1) is capable of rotating around an axis. The contact arm (1) may also be provided capable of rotating around a central bearing (50). This bearing is shown in the figures as circular hole, by way of example only. It is possible that there might be no bearing at all, only an axis of rotation. Or it is possible there might be a slot-shaped feature to compensate for unequal ablation of the contacts after switching operations. The contact arm (1) may float on symmetric springs. The slot shaped feature can be either provided vertical or on a slant.

The system can also be described in the following way as comprising a rotating contact arm (1) extending along an longitudinal axis (40) being capable of rotating around an axis or optional central bearing (50), the contact arm (1) being provided with a first movable contact (2) located on one of its ends on its lower surface and being provided with a second movable contact (9) located on the opposite end on its upper surface, a plurality of vertically stacked splitter plates (8), provided laterally adjacent to each end of the contact arm (1); a first conductor comprising: a first segment (4) extending below and parallel to that side of the contact arm (1) being provided with the first movable contact (2), the first segment (4) being provided with a fixed contact (3) on its upper surface for contacting the first movable contact (2); a second segment (12) extending above and parallel to that side of the contact arm (1) being provided with the sec-ond movable contact (9), the second segment (12) providing contact to an electric circuit on its end distant to the centre of the contact arm (1), and a third segment (18) vertically crossing the contact arm (1) and connecting the first segment (4) and the second segment (12) on their ends being close to the centre of the contact arm (1); a second conductor comprising a first segment (11) extending above and parallel to that side of the contact arm (1) being provided with the second movable contact (9) and below and parallel to the second element (12) of the first conductor, the first segment (11) being provided with a fixed contact (10) on its lower surface for contacting the second movable contact (9); a second segment (5) extending below and parallel to that side of the contact arm (1) being provided with the first movable contact (2) and parallel and below the first segment (4) of the first conductor, the second segment (5) providing contact to an electric circuit on its end distant to the centre of the contact arm (1), and a third segment (17) vertically crossing the contact arm (1) and connecting the first segment (11) and the second segment (5) on their ends being close to the centre of the contact arm (1).

The plane of motion of the contact arm (1) is defined by the longitudinal axis (40) and the vertical axis (41). The third segments are arranged parallel to the plane of motion of the contact arm (1). One third segment is provided in front of the contact arm (1), the other third segment (18) is provided behind the contact arm (1). Thus, the contact arm (1) is arranged between the third segments (17; 18) and rotates in a plane lying between the third segments (17; 18).

In FIG. 20, items 19 and 20 are representations of the electric arc during a short circuit. The electric arcs 19 and 20 are shown at a moment in time prior to moving in to the splitter plates B. In the intended function during a short circuit, magnetic force and gas flow will cause the arcs 19 and 20 to move outwardly and into the splitter plates B. The shape, number, and placement of the splitter plates 8 are shown only by way of example, as many variations are possible.

Figure 22:
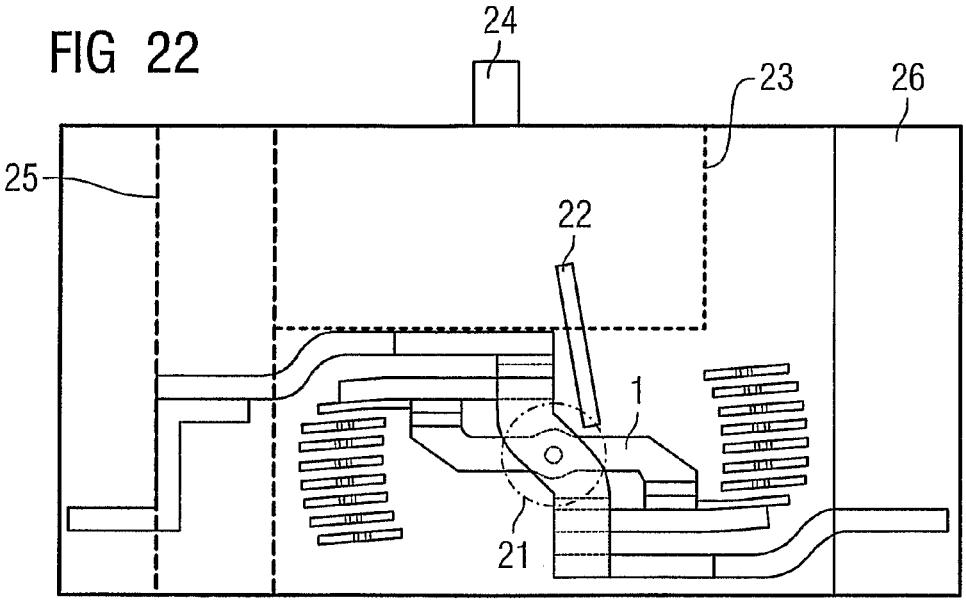
FIG. 22 Side view of embodiment of invention. This is an example of a possible embodiment within a molded case circuit breaker.

FIG. 22 shows a possible embodiment of the invention in an MCCB. A multi-pole MCCB will have an embodiment of the invention present in each pole separately. The contact systems for each pole are preferably arranged parallel to each other on a line. A crossbar system 21 provides a common carrier for the different contact arms 1 and rotates around a pivot axis fixed in the case 26.

The crossbar system 21 that actuates the opening and closing motion of the contact arm 1 during switching operations and is adapted to rotate around a pivot axis fixed in the molded case 26, the crossbar system 21 providing a rigid connection between poles in a multi-pole circuit breaker, so that switching operations all of the contact arms in all the poles will open or close simultaneously. The crossbar system 21 contains spring mechanisms providing contact pressure and allowing the contact arms 1 to open during a short circuit, responding to magnetic forces. Thus, the crossbar system 21 allows the contact arms 1 to open independently of an operating mechanism 23 during a short circuit and to open more rapidly than the operating mechanism.

The crossbar system 21 allows the multiple contact arms 1 in a multi-pole circuit breaker to open independently of each other. An operating mechanism 23 is further provided adapted to rotate the crossbar 21 open or closed. A link 22 connects and transfers motion from the operating mechanism 23 to the crossbar system 21. The operating mechanism rotates the crossbar system 21 open or closed in response to motion of the handle 24 or actuation by the trip unit 25.

The contact arms 1 of a multi pole system may be actuated simultaneously or independently. For instance, all contact arms 1 may be actuated together by a handle 24, or a specific contact arm 1 may be actuated automatically in response to a short circuit current in the corresponding pole.

The first and main advantage of an embodiment of the invention is that the fixed conductors provide twice the current for repelling the contact arm, compared with the prior art described above. In FIG. 19, the current in conductor segments 4 and 5 flows in the same direction, but opposite to the direction of current in the contact arm 1. Likewise the current in segments 11 and 12 are in the same direction, but opposite to the current flow in the contact arm 1. During a short circuit, each conductor carries the full short circuit current. Therefore a total of two times the short circuit current flows parallel to the contact arm 1, repelling the short circuit current in the contact arm. This greatly increases the forces an the contact arm in comparison with, for example, the simple reversed loop.

Referring to FIG. 20, a second advantage of an embodiment is that the crossover segments 17 and 18 have a current direction opposite to the direction of the arcing currents 19 and 20. This creates a repulsion force that aids in pushing the arc into the splitter plates. Each crossover segment carries the full short circuit current, so this repulsion force is generated by two times the short circuit current.

Figure 8:
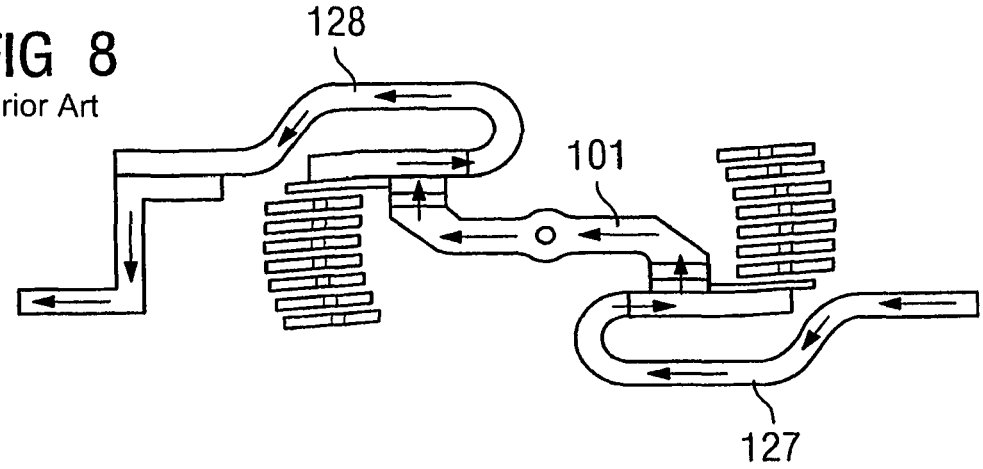
FIG 8 Prior Art
FIG. 8 Prior art. Side view of rotating, double-breaking contact system. Contact arm is shown closed. Arrows illustrate flow of electric current.
Figure 9:
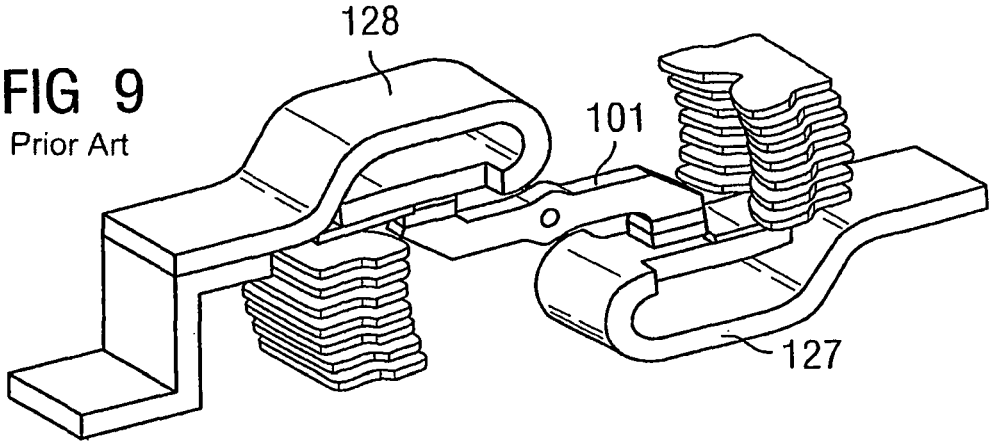
FIG 9 Prior Art
FIG. 9 Oblique view of device shown in FIG. B.
Figure 10:
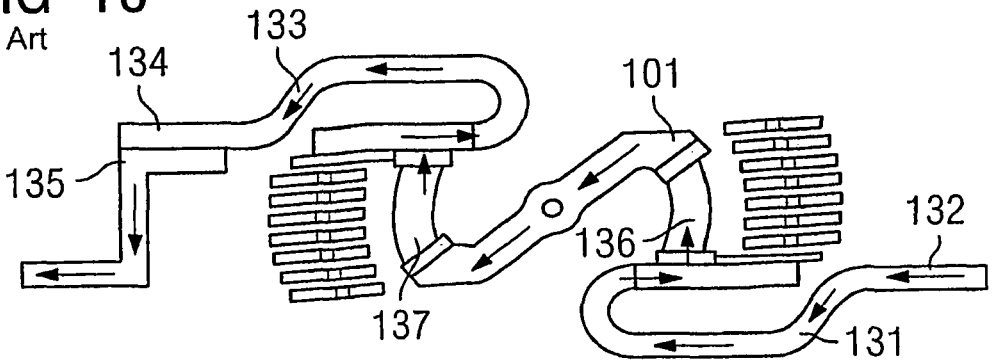
FIG 10 Prior Art
FIG. 10 Prior art. Another side view of device shown in FIG. B. Contact arm is shown fully open. Also shown is a representation of the electric arc, before it moves into the arc splitter plates. Arrows illustrate flow of electric current FIG. 11 Prior art. Side view of device shown in FIG. 1, but with ferromagnetic material (containing iron) added under the fixed contact.
Figure 11:
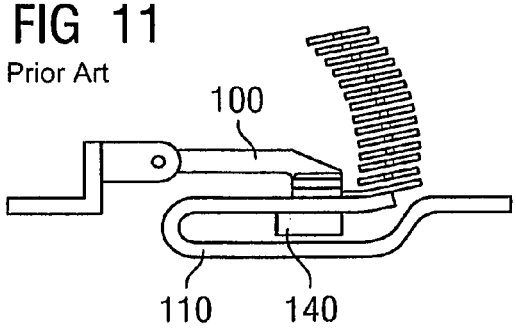
FIG 11 Prior Art
Figure 12:
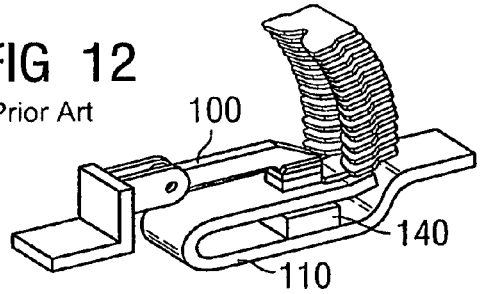
FIG 12 Prior Art
FIG. 12 Oblique view of device shown in FIG. 11.
Figure 13:
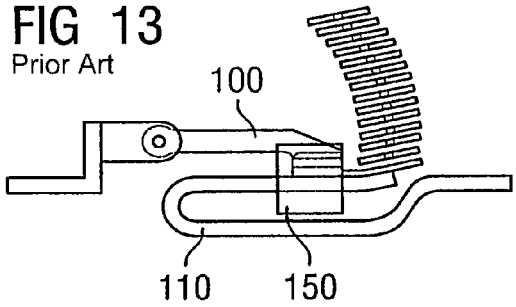
FIG 13 Prior Art
FIG. 13 Prior art. Side view of device shown in FIG. 1, but with a partial slot motor from ferromagnetic material.
Figure 14:
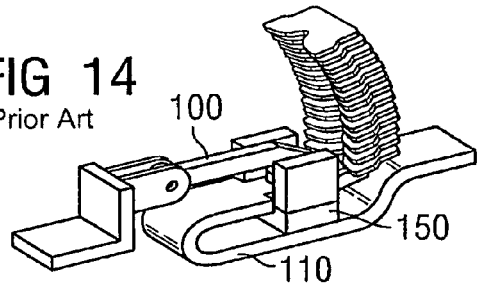
FIG 14 Prior Art
FIG. 14 Oblique view of device shown in FIG. 13.

A third advantage of an embodiment over the simple reversed loops in the prior art rotating double-break system, is that this invention does not have a return loop with disadvantageous current direction. Referring to FIG. 8, conductor segments 127 and 128 have current in the same direction as the contact arm current. This causes an attraction force that re-duces the net blow-apart force from the reverse loop. That undesirable effect is not present in an embodiment of invention.

Figure 1:
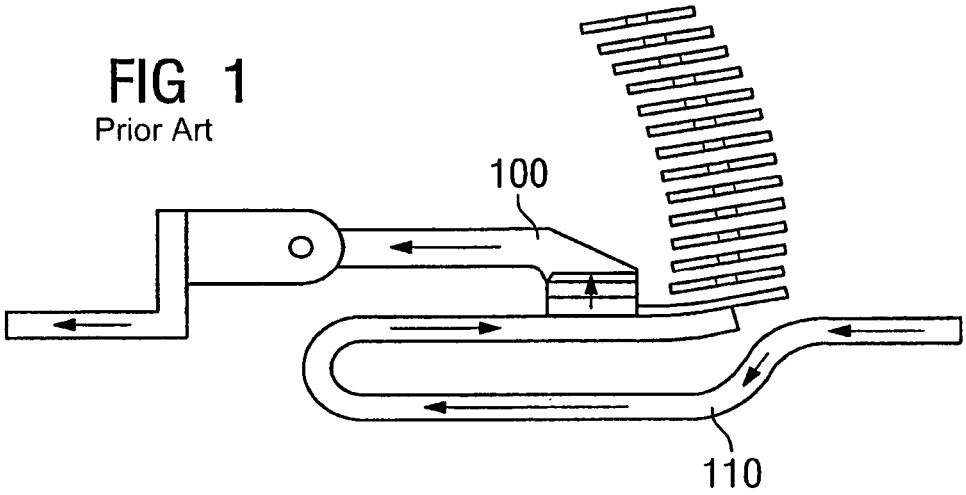
FIG 1 Prior Art
FIG. 1 Prior art. Side view of contact System with simple reverse loop. Arrows illustrate flow of electric current.
Figure 2:
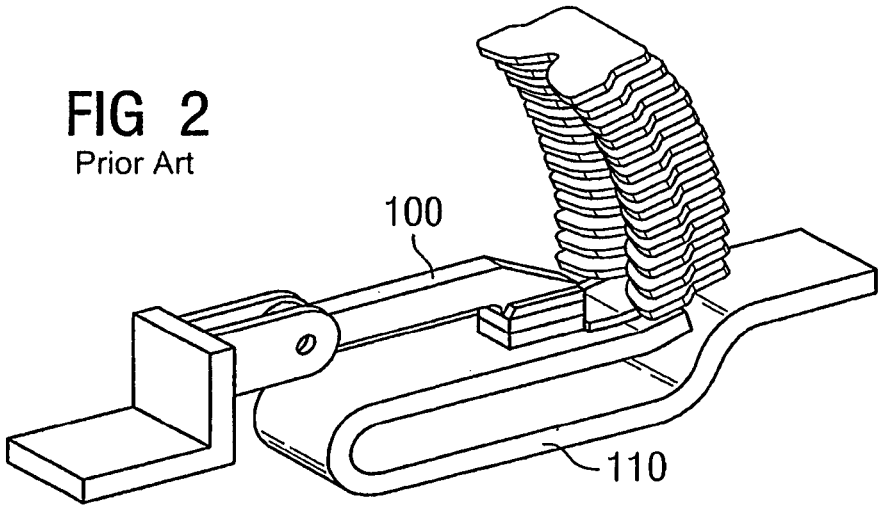
FIG 2 Prior Art
FIG. 2 Oblique view of device shown in FIG. 1.
Figure 3:
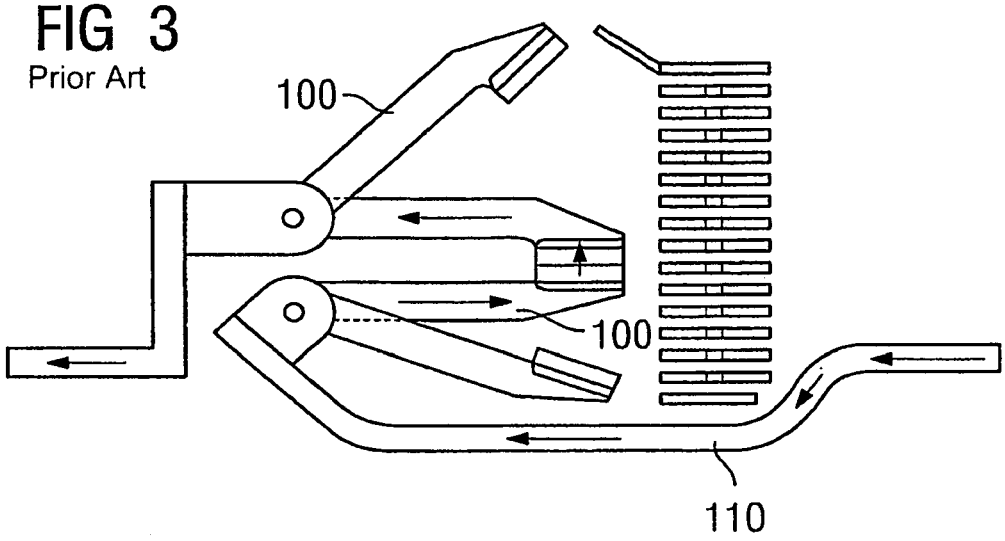
FIG 3 Prior Art
FIG. 3 Prior art. Side view of contact system with double-blow-apart contacts. Each contact arm is shown both closed and fully open. Arrows illustrate flow of electric current.
Figure 4:
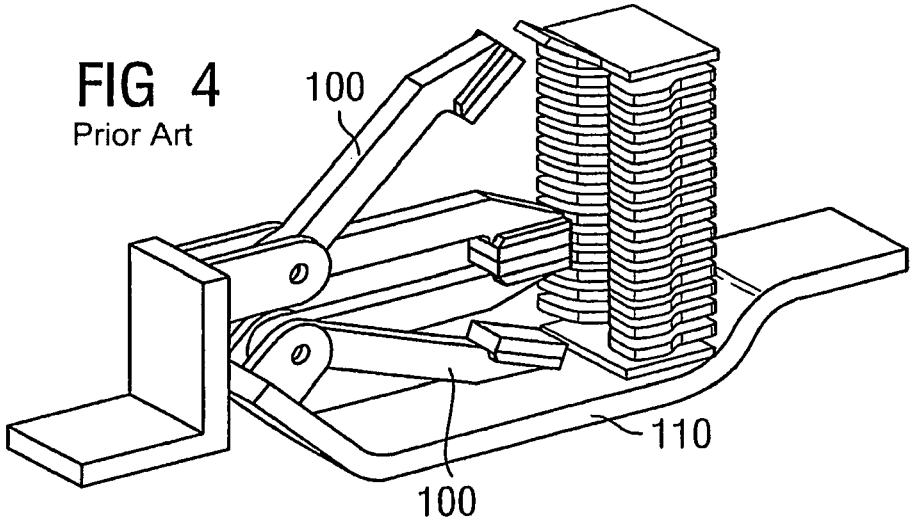
FIG 4 Prior Art
FIG. 4 Oblique view of device shown in FIG. 3.
Figure 5:
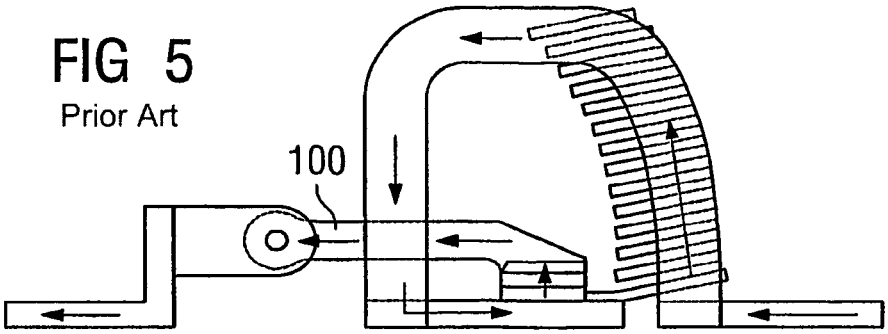
FIG 5 Prior Art
FIG. 5 Prior art. Side view of contact system with reverse loop combined with a return loop on the other side of the moving contact arm. Arrows illustrate flow of electric current.
Figure 6:
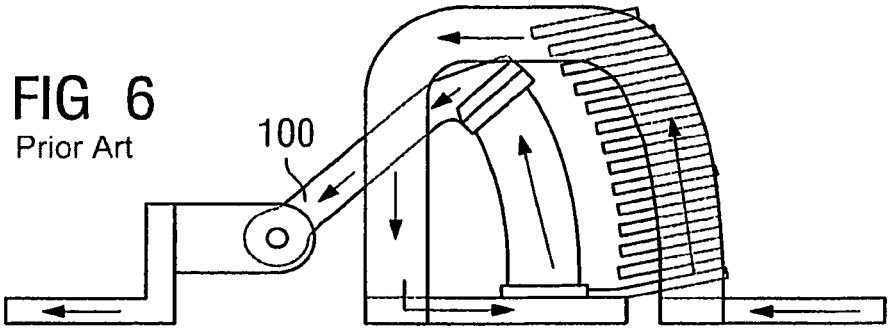
FIG 6 Prior Art
FIG. 6 is a side view of the device shown in FIG. 5, wherein the contact arm is open. Also shown in FIG. 6 is a representation of the electric arc, before it moves into the arc splitter plates. Arrows illustrate flow of electric current.
Figure 7:
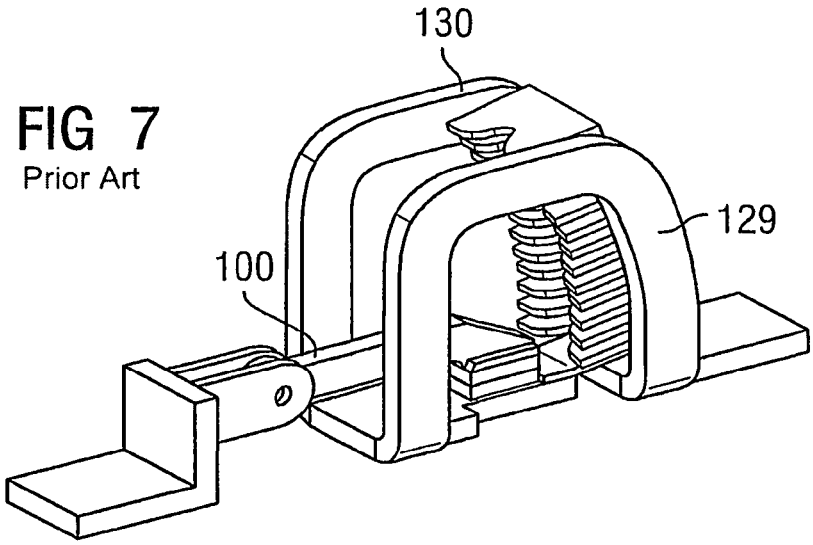
FIG 7 Prior Art
FIG. 7 Oblique view of device shown in FIG. 5.

A fourth advantage is that an embodiment of the invention avoids a problem present in the concept shown in FIG. 7. The conductor segments 129 and 130 are located on the left and right sides of the splitter plates. This arrangement has a problem of crowded space across the width of the MCCB. Either the MCCB must be made wider to accommodate the thickness of the conductors, or else the splitter plates must be made narrower, which reduces their effectiveness in cooling the arc.

Referring to FIG. 20, a fifth advantage of an embodiment is that the current in conductor segments 6 and 7 is in direction that will produce an attractive force with the electric arc 19. This produces the desirable effect of tending to move the arc into the splitter plates. Likewise, segments 13, 14, and 15 attract the arc 20. Contrasting this with the disadvantageous condition in the prior art in FIG. 10, segments 131 and 132 tend to repel the arc 136, and segments 133, 134, and 135 tend to repel the arc 137, respectively.

Figure 23:
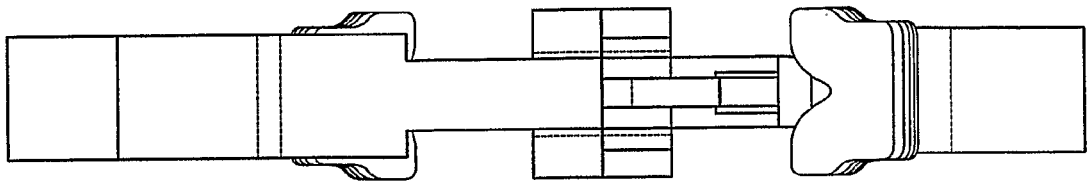
FIG. 23 Top view of embodiment of invention.
Figure 24:
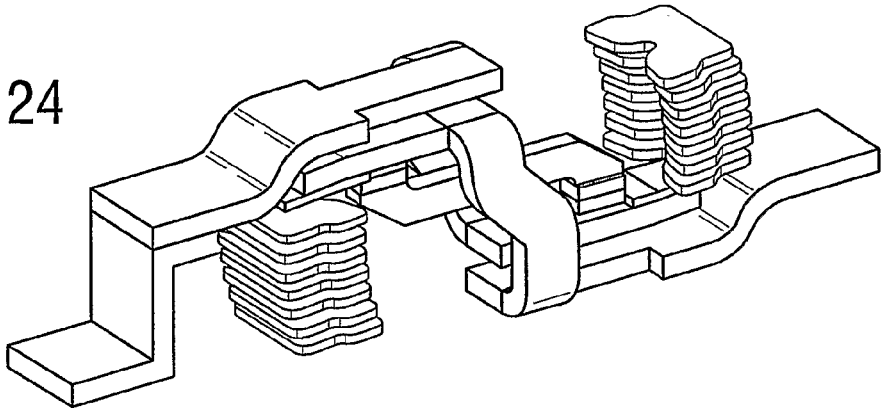
FIG. 24 Another oblique view of embodiment of invention.
Figure 25:
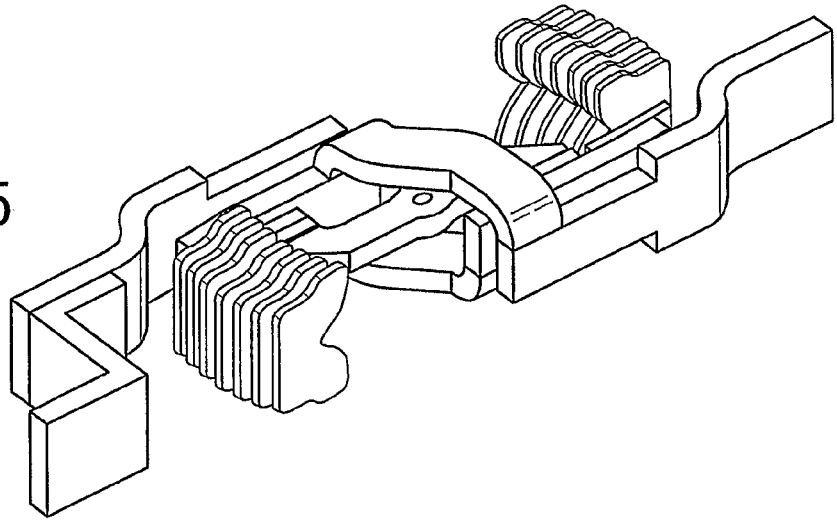
FIG. 25 Another oblique view of embodiment of invention.

FIGS. 23 to 25 show the described embodiment of the present invention from different perspectives, i.e from a top view (FIG. 23), a side view (FIG. 24) and an upside down side view (FIG. 24).

FIGS. 26-31 are examples of alternative embodiments of the invention that make use of various arrangements of ferromagnetic material. In each of these cases the ferromagnetic material intensifies the magnetic flux crossing through the contact arm, thereby increasing the opening forces on the contact arm, and also increases forces that push the arcs into the splitter plates.

Figure 15:
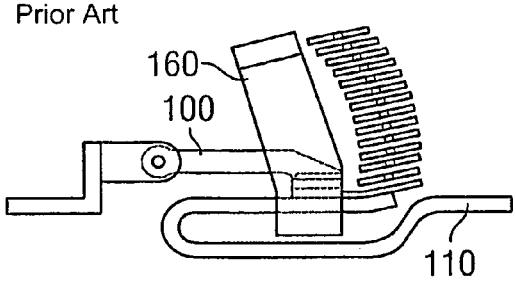
FIG 15 Prior Art
FIG. 15 Prior art. Side view of device shown in FIG. 1, but with a full slot motor from ferromagnetic material.
Figure 16:
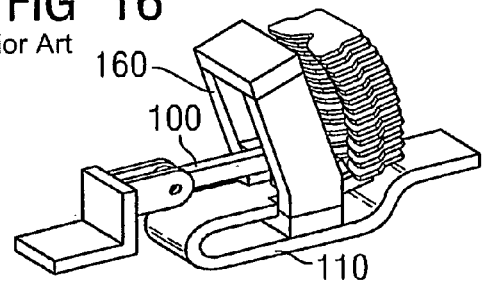
FIG 16 Prior Art
FIG. 16 Oblique view of device shown in FIG. 15.
Figure 27:
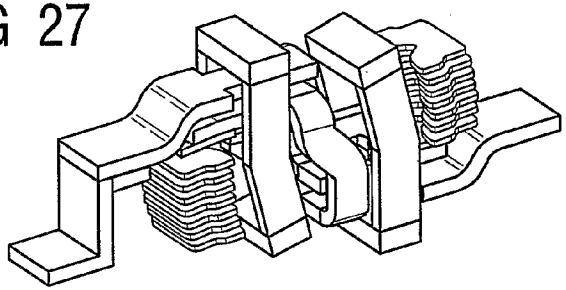
FIG. 27 Oblique view of the device in FIG. 26.
Figure 26:
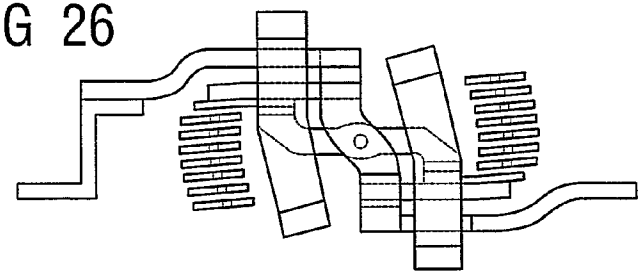
FIG. 26 Side view. Alternative form of embodiment of invention

FIGS. 26 and 27 show the invention with two full slot motors. Each slot motor comprises a complete loop of ferromagnetic material that encircles portions of the conducting path. One of the slot motors encircles conductor segments 4, 5 and the contact arm 1. The other slot motor encircles conductor segments 11, 12 and the contact arm 1. Each of these slot motors intensifies the magnetic field in the manner known in prior art, such as shown in FIGS. 15 and 16. But the advantage gained is greater in an embodiment of the invention than in prior art, because each slot motor has twice the current flowing through it in the fixed conductors. The increased current induces greater magnetic field intensity in the slot motor, thereby increasing the beneficial forces on the contact arm and on the arc.

Figure 29:
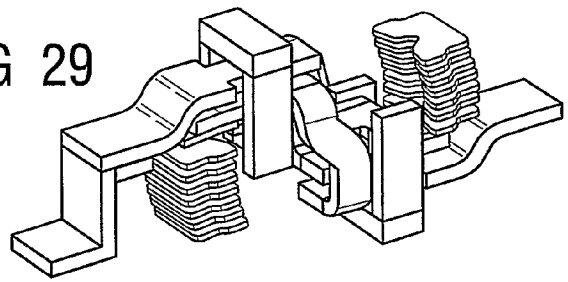
FIG. 29 Oblique view of the device in FIG. 28.
Figure 28:
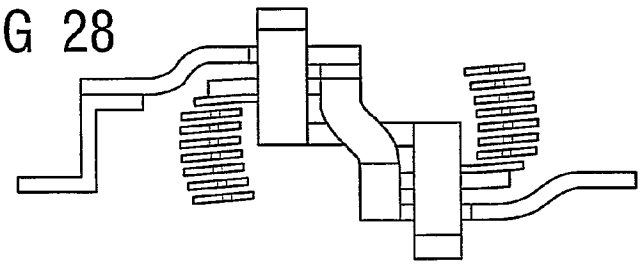
FIG. 28 Side view. Alternative form of embodiment of invention.

FIGS. 28 and 29 show an embodiment of the invention with two partial slot motors. The advantages gained are similar to the full slot motor in FIGS. 26 and 27. However, the increase of forces on the contact arm and arcs is not as great as the full slot motor. The partial slot motor is shaped to intensify the magnetic flux, but it does not completely encircle the conductors. But the partial slot motor has the advantage that it requires less space than the full slot motor, and might be easier for the product designer to implement into a complete product.

Figure 17:
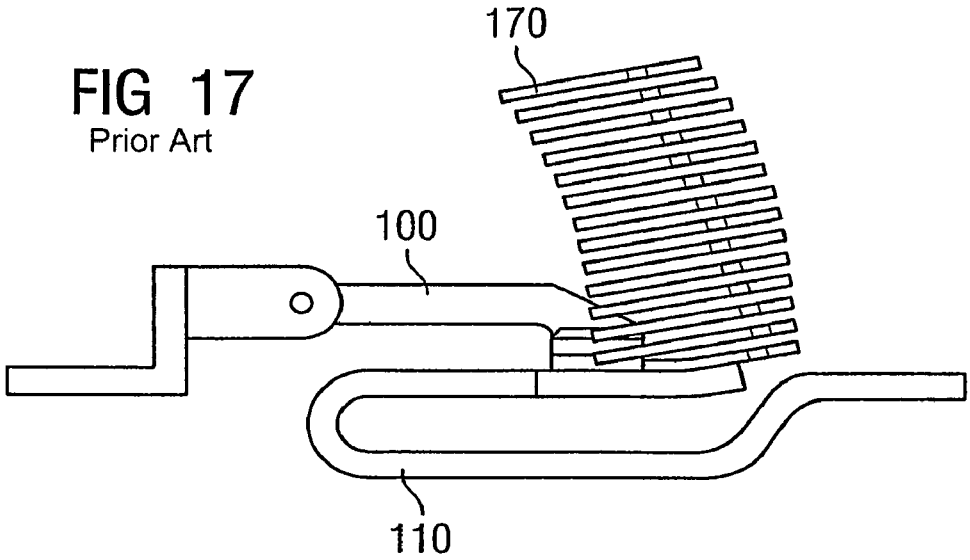
FIG 17 Prior Art
FIG. 17 Prior art. Side view of device shown in FIG. 1, but with arc splitter plates, made from ferromagnetic iron, having long legs extending to the sides of the contact.
Figure 18:
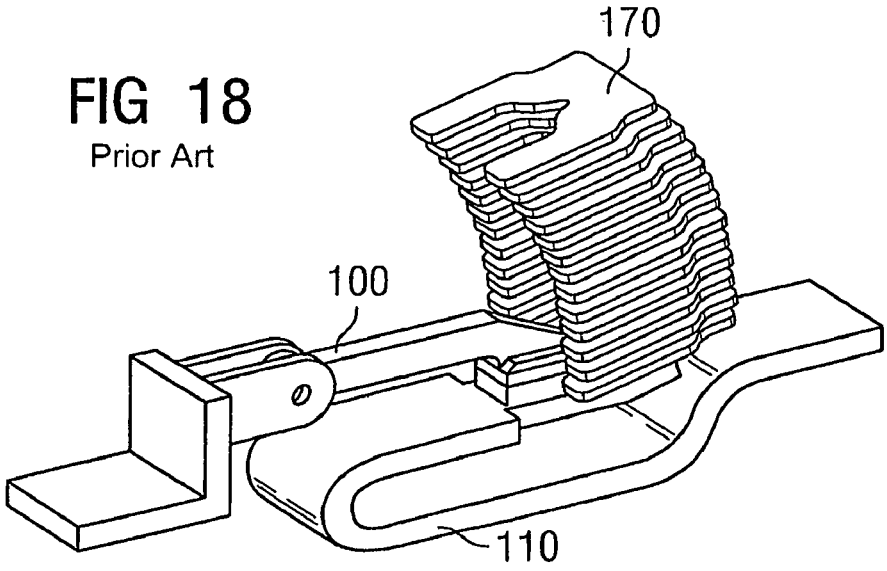
FIG 18 Prior Art
FIG. 18. Oblique view of device shown in FIG. 17.
Figure 31:
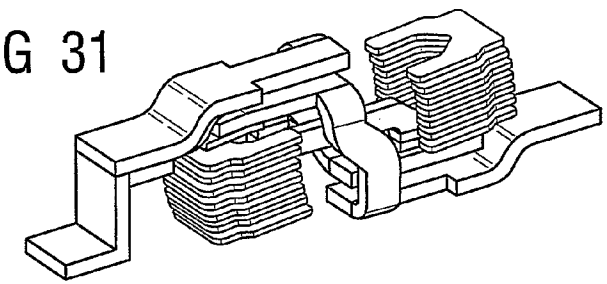
FIG. 31 Oblique view of the device in FIG. 30.
Figure 30:
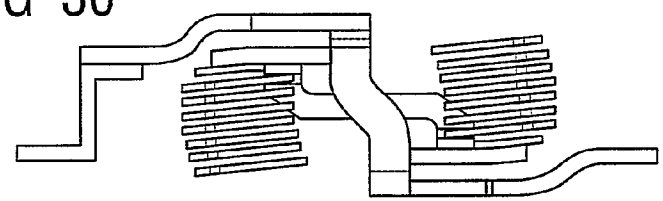
FIG. 30 Side view. Alternative form of embodiment of invention long legs extending to the sides of the contacts.

FIGS. 30 and 31 show an embodiment of the invention with arc splitter plates, made from ferromagnetic material, with long legs extending to the sides of the contacts. Such splitter plates are known in prior art for example as shown in FIGS. 17 and 18.

In other words, in at least one example embodiment, the double-breaking contact system has two stationary conductors which are formed from the segments 7, 6, 5, 17 and 11, and 4, 18, 12, 13 and 14, respectively. In the closed position, the conductors are connected via the rotating contact arm 1 in the form of a double lever, which extends along the longitudinal axis 40 and can pivot about the rotation axis, which runs transversely with respect to the longitudinal axis 40. The moving contacts 2, 9 (in the form of contact pieces) are arranged at the free ends of the rotating contact arm 1, that is to say each end of the rotating contact arm is fitted with a respective moving contact 2, 9. The contacts 2, 9 point in opposite directions and interact with the fixed contacts 3, 10 (the contact pieces) which are respectively arranged on the first and the second conductor. When the rotating contact arm 1 is located in the closed position, that is to say when the contacts 2, 3 and 9, 10 are closed, the two conductors run transversely with respect to the rotating contact arm 1 in the area of the rotation axis, that is to say the segments 18, 17, and essentially parallel to one another in the adjacent area, that is to say the segments 4, 5 and 11, 12 and as far as the associated fixed contact. That is to say they run in the same direction as the rotating contact arm 1. They are connected to one another via the rotating contact arm 1 such that the current is effectively fed back in terms of direction via the rotating contact arm 1 such that the current in each case flows in the same direction in the areas (the segments 4, 5 and 11, 12) which run in pairs parallel to the rotating contact arm (1).

LIST OF REFERENCE SIGNS

1 rotating double-breaking contact arm
2 movable contact
3 fixed contact
4 load conductor segment
5 line conductor segment
6 line conductor segment
7 line conductor segment
8 splitter plates
9 movable contact
10 fixed contact
11 line conductor segment
12 load conductor segments
13 load conductor segments
14 load conductor segments
15 conducting path
16 load terminal connection
17 line conductor segment
18 load conductor segments
19 electric arc
20 electric arc
21 crossbar
22 link
23 operating mechanism
24 handle
25 trip unit
26 base
40 longitudinal axis
41 vertical axis
50 central axis of rotation or bearing
100 rotatable contact arm
101 rotatable double-breaking contact arm
110 fixed conductor
127 conductor segment
128 conductor segment
129 conductor segment
130 conductor segment
131 conductor segment
132 conductor segment
133 conductor segment
134 conductor segment
135 conductor segment
136 electric arc
137 electric arc
140 ferromagnetic material
150 partial slot motor
160 full slot motor Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A double-breaking contact system for a low voltage circuit breaker, comprising:

first and second stationary conductors, connected in a closed position via a rotatable contact arm in the form of a double lever, the rotatable contact arm extending along a longitudinal axis and pivotable about a rotation axis which runs transversely with respect to the longitudinal axis; and first and second movable contacts, arranged at free ends of the rotatable contact arm, the first and second movable contacts pointing in mutually opposite directions and interacting with fixed contacts, the fixed contacts being respectively arranged on the first and second stationay conductors, wherein the first and second stationary conductors, in a closed position when the contacts are closed, run transversely with respect to the rotatable contact arm and in an area of the rotation axis, run essentially parallel to one another in the adjacent area, and wherein the first and second stationary conductors are connected to one another via the rotatable contact arm such that current is fed back via the rotatable contact arm, and wherein the current flows in a same direction in areas which run in pairs parallel to the rotating contact arm.

2. System according to claim 1, wherein the first and second stationary conductors are provided staggered along a vertical axis with respect to each other, such that a first segment of the first* stationary conductor is arranged on top of and parallel to a first segment of the second stationary conductor, and a second segment of the first stationary conductor is arranged on top of and parallel to a second segment of the second stationary conductor.

3. System according to claim 2, wherein the first and second segments are centered within the plane of motion of the contact arm.

4. A molded case circuit breaker comprising:

at least one contact system according to claim 2;

a molded case;

a crossbar system to provide a carrier for contact arms for actuating the opening and closing motion of a contact arm of the at least one contact system, the crossbar system being adapted to rotate around a pivot axis fixed in the molded case, the crossbar system containing spring mechanisms providing contact pressure and allowing the contact arm to open during a short circuit;

an operating mechanism adapted to rotate the crossbar system open or closed; and a link adapted to connect and transfer motion from the operating mechanism to the crossbar system.

5. System according to claim 1, wherein pluralities of vertically stacked splitter plates are provided laterally adjacent to each end of the contact arm.

6. System according to claim 1, wherein segments of the first and second stationary conductors are arranged approximately at right angles to the longitudinal axis.

7. System according to claim 1, wherein segments of the first and second stationary conductors are arranged to allow the contact arm to rotate between a first closed and a second open position.

8. System according to 7, wherein said segments cross said contact arm on different sides of the contact arm, respectively.

9. System according to claim 1, wherein the contact arm is provided with said contacts and are fixed to its ends.

10. System according to claim 1, wherein the first stationary conductor and the second stationary conductor are each respectively provided with a contact.

11. System according to claim 1, wherein the first stationary conductor is realized as the line conductor and wherein the second stationary conductor is realized as the load conductor.

12. System according to claim 1, wherein each of the first and second stationary conductors is adapted to connect with an electrical circuit on an end which is not connected to the contact arm.

13. System according to claim 1, wherein the first stationary conductor comprises: a first segment extending below and parallel to that side of the contact arm being provided with the first movable contact, a fixed contact being provided on an upper surface of the first segment for contacting the first movable contact in a first closed position of the contact arm; a second segment extending above and parallel to that side of the contact arm being provided with the second movable contact, the second segment providing contact to an electric circuit on its end distant to the center of the contact arm, and a third segment vertically crossing the contact arm and connecting the first segment and the second segment on their ends being close to the center of the contact arm.

14. System according to claim 13, wherein the second stationary conductor comprises: a first segment extending above and parallel to that side of the contact arm being provided with the second movable contact and below and parallel to the second segment of the first stationary conductor, a fixed contact on a lower surface of the first segment for contacting the second movable contact in a first closed position of the contact arm; a second segment extending below and parallel to that side of the contact arm being provided with the first movable contact and parallel and below the first segment of the first stationary conductor, the second segment providing contact to an electric circuit on its end distant to the center of the contact arm, and a third segment vertically crossing the contact arm and connecting the first segment and the second segment on their ends being close to the center of the contact arm.

15. System according to claim 14, wherein the first and second conductors are isolated from each other when the contact arm is in the second open position.

16. System according to claim 15, wherein the current arm is capable of rotating between a first position providing a closed contact between an end of the contact arm with a corresponding end of the first stationary conductor and the other end of the contact arm with the corresponding end of the second stationary conductor, respectively, and a second open position following a short circuit, wherein the contacts between the conductors and the contact arm are adapted to allow the formation of current arcs and on either end of the contact arm.

17. System according to 16, wherein the third segments are arranged to guide a current in a direction opposite to the direction of the arc currents for creation of a repulsion force and for pushing the arcs into the respective splitter plates.

18. System according to claim 1, wherein vertical s-shaped like segments and are connected to a first element of the second stationary conductor and a second element of the first stationary conductor, respectively, such that an upward current flow is provided in the level changing part of the s-shaped segment and a downward current flow is provided in the level changing part of the s-shaped segment.

19. System according to claim 18, wherein the flow of a current in the s-shaped segments attracts a respective current arc for guiding the arcs into the splitter plates.

20. System according to claim 1, wherein the rotatable contact arm rotates in a plane defined by the longitudinal axis and the vertical axis.

21. System according to claim 1, wherein the rotatable contact arm is provided rotatable across a central axis or a central bearing.

22. System according to claim 2, wherein pluralities of vertically stacked splitter plates are provided laterally adjacent to each end of the contact arm.

23. System according to claim 2, wherein the first fixed conductor comprises: the first segment extending below and parallel to that side of the contact arm being provided with the first movable contact, a fixed contact being provided on an upper surface of the first segment for contacting the first movable contact in a first closed position of the contact arm; the second segment extending above and parallel to that side of the contact arm being provided with the second movable contact, the second segment providing contact to an electric circuit on its end distant to the center of the contact arm, and the third segment vertically crossing the contact arm and connecting the first segment and the second segment on their ends being close to the center of the contact arm.

24. System according to claim 23, wherein the second fixed conductor comprises: the first segment extending above and parallel to that side of the contact arm being provided with the second movable contact and below and parallel to the second element of the first fixed conductor, a fixed contact on a lower surface of the first segment for contacting the second movable contact in a first closed position of the contact arm; the second segment extending below and parallel to that side of the contact arm being provided with the first movable contact and parallel and below the first segment of the first fixed conductor, the second segment providing contact to an electric circuit on its end distant to the center of the contact arm, and the third segment vertically crossing the contact arm and connecting the first segment and the second segment on their ends being close to the center of the contact arm.

25. A molded case circuit breaker comprising:

at least one contact system according to claim 1;

a molded case;

a crossbar system to provide a carrier for contact arms for actuating the opening and closing motion of a contact arm of the at least one contact system, the crossbar system being adapted to rotate around a pivot axis fixed in the molded case, the crossbar system containing spring mechanisms providing contact pressure and allowing the contact arm to open during a short circuit;

an operating mechanism adapted to rotate the crossbar system open or closed; and a link adapted to connect and transfer motion from the operating mechanism to the crossbar system.

26. The molded case circuit breaker of claim 25, wherein the operating mechanism is realized as at least one of a handle and a trip unit.

27. The molded case circuit breaker of claim 26, wherein a contact system is provided for each pole of an electric circuit, the contact systems being arranged parallel to each other, the crossbar system providing a rigid connection between each contact arm.

28. The molded case circuit breaker of claim 25, wherein a contact system is provided for each pole of an eletric circuit, the contact systems being arranged parellel to each other, the crossbar system providing a rigid connection between each contact arm.

29. The molded case circuit breaker according to claim 28, wherein the crossbar system is adapted to rotate the contact arms of all poles at least one of simultaneously and independently from each other.

30. Method for breaking an electric current in a circuit following a short in double-breaking contact system for a low voltage circuit breaker including a double breaking contact arm extending along a longitudinal axis; a first fixed conductor and a second fixed conductor, each of the first and second fixed conductors contacting one respective end of the contact arm and having first segments below the contact arm, second segments above the contact arm and third segments crossing over the contact arm and connecting the first segments with the corresponding second segments of each conductor, the method comprising at least one of:

providing a repulsion force between current in the contact arm and current in the first segments on one end of the contact arm by arranging the first segments parallel and adjacent to each other and guiding the current in a parallel direction through the first segments but in a reverse direction with respect to the current in the contact arm; and providing a repulsion force between the current in the contact arm and the current in the second segments on the other end of the contact arm by arranging the second segments parallel and adjacent to each other and guiding the current in a parallel direction through the first segments but in a reverse direction with respect to the current in the contact arm.

31. Method according to 30, further comprising:

rotating the contact arm from a first closed position to a second open position due to said repulsion force;

forming an electric arc between one end of the contact arm and a contact on the first fixed conductor and forming of an electric arc between the other end of the contact arm and a contact on the second fixed conductor; and creating an additional repulsion force by guiding a current through the third segments in a direction opposite to the direction of the arc currents for pushing the arcs away from the center of the contact arm.

32. Method according to claim 31, wherein the system is further provided with vertical s-shaped like segments and connected to the first segment of the second fixed conductor and the second segment of the first fixed conductor, respectively, the method further comprising:

guiding a current flow upward in the level changing part of the s-shaped segment and downward in the level changing part of the s-shaped segment creating an attraction force through said guiding between the respective current arcs and the upward and downward current flow for guiding the arcs away from the center of the contact arm, respectively.

33. Method according to claim 30, wherein the system is further provided with vertical s-shaped like segments and connected to the first segment of the second fixed conductor and the second segment of the first fixed conductor respectively, the method further comprising:

guiding a current flow upward in the level changing part of the s-shaped segment and downward in the level changing part of the s-shaped segment creating an attraction force through said guiding between the respective current arcs and the upward and downward current flow for guiding the arcs away from the center of the contact arm, respectively.

34. A double-breaking contact system for a low voltage circuit breaker, comprising:

a rotatable double-breaking contact arm extending along a longitudinal axis;a first fixed conductor and a second fixed conductor, each first and second fixed conductor contacting one respective end of the rotatable double-breaking contact arm and including first segments below the rotatable double-breaking contact arm, second segments above the rotatable double-breaking contact arm and third segments crossing over the rotatable double-breaking contact arm and connecting the first segments with the corresponding second segments of each conductor, and at least one of the first segments being arranged parallel to each other for guiding a current in a parallel direction through the respective first segments, but reverse to the current in the contact arm, and the second segments being arranged parallel to each other for guiding a current in a parallel direction through the respective second segments, but reverse to the current in the contact arm.

* * * * *